US008113267B2

(12) United States Patent
Otsuka et al.

(10) Patent No.: US 8,113,267 B2
(45) Date of Patent: Feb. 14, 2012

(54) TWIN-ROLL CASTING MACHINE

(75) Inventors: Hiroyuki Otsuka, Tokyo (JP); Katsumi Nakayama, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 12/663,448

(22) PCT Filed: Jun. 18, 2008

(86) PCT No.: PCT/JP2008/001575

§ 371 (c)(1),
(2), (4) Date: Dec. 7, 2009

(87) PCT Pub. No.: WO2008/155914

PCT Pub. Date: Dec. 24, 2008

(65) Prior Publication Data

US 2010/0163204 A1 Jul. 1, 2010

(30) Foreign Application Priority Data

Jun. 19, 2007 (JP) ..... 2007-161039

(51) Int. Cl.
*B22D 11/06* (2006.01)
*B22D 11/10* (2006.01)

(52) U.S. Cl. ..... 164/428; 164/430; 164/434; 164/437; 164/480; 164/488; 222/591

(58) Field of Classification Search ..... 164/428, 164/434, 430, 437, 480, 488; 222/591, 606, 222/607

See application file for complete search history.

(56) References Cited

U.S. PATENT DOCUMENTS

| | | | | | |
|---|---|---|---|---|---|
| 4,485,835 | A | * | 12/1984 | Huber et al. | 164/430 |
| 4,694,887 | A | * | 9/1987 | Matsui et al. | 164/428 |
| 5,857,514 | A | * | 1/1999 | Shook et al. | 164/480 |
| 6,012,508 | A | * | 1/2000 | Folder | 164/480 |
| 6,125,917 | A | * | 10/2000 | Cassar et al. | 164/428 |
| 7,398,817 | B2 | * | 7/2008 | Capotosti et al. | 164/428 |
| 7,926,549 | B2 | * | 4/2011 | Cooper et al. | 164/480 |

FOREIGN PATENT DOCUMENTS

| | | | |
|---|---|---|---|
| JP | 5-177312 | | 7/1993 |
| JP | 6-15415 | | 1/1994 |
| JP | 6-114505 | | 4/1994 |
| JP | 08155593 | A * | 6/1996 |
| JP | 9-225596 | | 9/1997 |
| JP | 11-254097 | | 9/1999 |
| JP | 2000-202590 | | 7/2000 |
| JP | 2005-125337 | | 5/2005 |
| JP | 2007-203337 | | 8/2007 |

OTHER PUBLICATIONS

Chinese Office Action dated Jul. 21, 2011 in Chinese Patent Application No. 200880020629.5 filed Jun. 18, 2008 (with English Translation).

* cited by examiner

*Primary Examiner* — Jessica L Ward
*Assistant Examiner* — Devang R Patel
(74) *Attorney, Agent, or Firm* — Oblon, Spivak, McClelland, Maier & Neustadt, L.L.P.

(57) ABSTRACT

Provided is a twin-roll casting machine capable of suppressing irregularities in crosswise thickness distribution of a strip. The twin-roll casting machine comprises chilled rolls, side weirs, and nozzle pieces. A plurality of openings for supply of molten metal to between the chilled rolls are formed alternately on portions of each of the nozzle pieces adjacent to the one and the other rolls, respectively, and are spaced apart from each other axially of the rolls.

3 Claims, 6 Drawing Sheets

TWIN-ROLL CASTING MACHINE

TECHNICAL FIELD

The present invention relates to a twin-roll casting machine.

BACKGROUND ART

Known as one of techniques for directly producing a strip from molten metal is twin-roll continuous casting in which molten metal is supplied to between a pair of rotated rolls so as to deliver solidified metal in the form of strip.

FIGS. 1-3 show an example of a conventional twin-roll casting machine with a pair of chilled rolls 1*a* and 1*b* horizontally juxtaposed and a pair of side weirs 2*a* and 2*b* associated with the rolls 1*a* and 1*b*.

The rolls 1*a* and 1*b* are constructed such that cooling water passes through insides of the rolls, a nip G between the rolls being controllable to be increased or decreased depending upon thickness of a strip 3 to be produced.

Velocity and direction of rotation of the rolls 1*a* and 1*b* are set such that the outer peripheries of the respective rolls move from above towards the nip G at the same velocity.

The one and the other side weirs 2*a* and 2*b* surface-contact one and the other ends of the rolls 1*a* and 1*b*, respectively. Nozzle pieces 4*a* and 4*b* for supply of molten metal are arranged in a space defined by the rolls 1*a* and 1*b* and side weirs 2*a* and 2*b* so as to be positioned just above the nip G (see, for example, Patent Literature 1).

The one and the other nozzle pieces 4*a* and 4*b* are supported to have a constant gap against the one and the other side weirs 2*a* and 2*b*, respectively.

Each of the nozzle pieces 4*a* and 4*b* has a top with an elongated nozzle trough 6 for reception of molten metal 5, and longitudinal side walls each with a plurality of openings 7 at portions of the walls adjacent to lower ends of the walls so as to supply the molten metal 5 from the nozzle trough 6 to between the rolls 1*a* and 1*b*, the openings 7 being spaced apart from each other axially of the roll 1*a*, 1*b*. Pouring of the molten metal 5 into the respective nozzle troughs 6 provides a molten metal pool 8 above the nip G and in contact with outer peripheries of the rolls 1*a* and 1*b*.

As shown by arrows in FIG. 2(*a*), with respect to each of the nozzle pieces 4*a* and 4*b*, the openings 7 are formed symmetrically at the portions adjacent to the one and the other rolls 1*a* and 1*b*, respectively.

In the above-mentioned twin-roll casting machine, the molten metal pool 8 is formed and the rolls 1*a* and 1*b* are rotated with the cooling water passing through and cooling the rolls 1*a* and 1*b*, so that molten metal 5 is solidified on the outer peripheries of the rolls 1*a* and 1*b* into solidified shells 9 so as to deliver downward the strip 3 from the nip G.

In this case, loads are applied to necks of the respective rolls 1*a* and 1*b* in directions toward each other so as to make the produced strip 3 to have a targeted thickness.

[Patent Literature 1] JP 2000-202590A

SUMMARY OF INVENTION

Technical Problems

However, with respect to each of the nozzle pieces 4*a* and 4*b*, symmetrical formation of the openings 7 at the portions adjacent to the one and the other rolls 1*a* and 1*b* brings about the molten metal 5 in the pool 8 flowing faster at the portions adjacent to the openings 7 than at the other portions, so that the molten metal 5 is difficult to cool on the outer peripheries of the rolls 1*a* and 1*b* adjacent to the openings 7.

Thus, as shown in FIG. 2(*b*), solidification of the shells 9 progresses (with thickness increased) on the outer peripheries of the rolls 1*a* and 1*b* at portions away from the openings 7 while solidification of the shells 9 is hard to progress on the outer peripheries of the rolls 1*a* and 1 at portions adjacent to the openings 7.

As a result, the strip 3 to be delivered from the rolls 1*a* and 1*b* is formed with ridges of the shells 9 with progressed solidification being brought together while unsolidified regions 10 remain at valleys between the adjacent ridges axially of the rolls 1*a* and 1*b* as shown in FIG. 2(*c*).

Thus, as shown in FIG. 2(*d*), the strip 3 completely contracted due to solidification has irregularities in crosswise thickness distribution with disadvantageous result that cracks may be produced.

The invention was made in view of the above and has its object to provide a twin-roll casting machine capable of suppressing irregularities in crosswise thickness distribution of a strip.

Solution to Problems

In order to attain the above object, in a first aspect of the invention, provided are a pair of chilled rolls, a pair of side weirs and a nozzle piece arranged in a space defined by said rolls and said side weirs, said nozzle piece being formed with a plurality of molten-metal delivery openings spaced apart from each other axially of the rolls at portions of the nozzle piece adjacent to one and the other rolls, respectively, said openings adjacent to the one roll being in antiphase to those adjacent to the other roll.

In a second aspect of the invention, provided are a pair of chilled rolls, a pair of side weirs and first and second nozzle pieces arranged in tandem axially of the rolls and in a space defined by said rolls and said side weirs, each of said first and second nozzle pieces being formed with a plurality of molten-metal delivery openings spaced apart from each other axially of the rolls at portions of the nozzle piece adjacent to one and the other of the rolls, respectively, said openings adjacent to the one roll being in antiphase to those adjacent to the other roll.

In a third aspect of the invention, the first nozzle piece is set to have smaller and greater molten-metal delivery ranges axially along the one and the other rolls, respectively, and the second nozzle piece is set to have greater and smaller molten-metal delivery ranges axially along the one and the other rolls, respectively.

In a fourth aspect of the invention, each of the openings has cross section elongated axially of the rolls.

Advantageous Effects of Invention

According to a twin-roll casting machine of the invention, the following excellent effects and advantages can be obtained.

(1) The openings of the nozzle piece adjacent to the one roll are in antiphase to those adjacent to the other roll, so that the solidified shells on the outer peripheries of the one and the other rolls can be brought together with ridges and valleys of the solidified shell on the outer periphery of the one roll being confronted to valleys and ridges of the solidified shell on the outer periphery of the other roll, respectively.

(2) Thus, the strip delivered from the rolls has tendency of being equalized with no irregularities in crosswise thickness distribution, cracks being prevented from being produced.

(3) When the first and second nozzle pieces are arranged in tandem and the first nozzle piece is set to have the smaller and larger molten-metal delivery ranges axially along the one and the other rolls, respectively, and the second nozzle piece is set to have the larger and smaller molten-metal delivery ranges axially along the one and the other rolls, respectively, then a ridge of the solidified shell on the outer periphery of the one roll at axially intermediate portion thereof is not confronted to a ridge of the solidified shell on the outer periphery of the other roll at axially intermediate portion thereof with an advantageous result that the strip delivered by the rolls has further equalized crosswise thickness distribution.

REFERENCE SIGNS LIST

Figure 1:
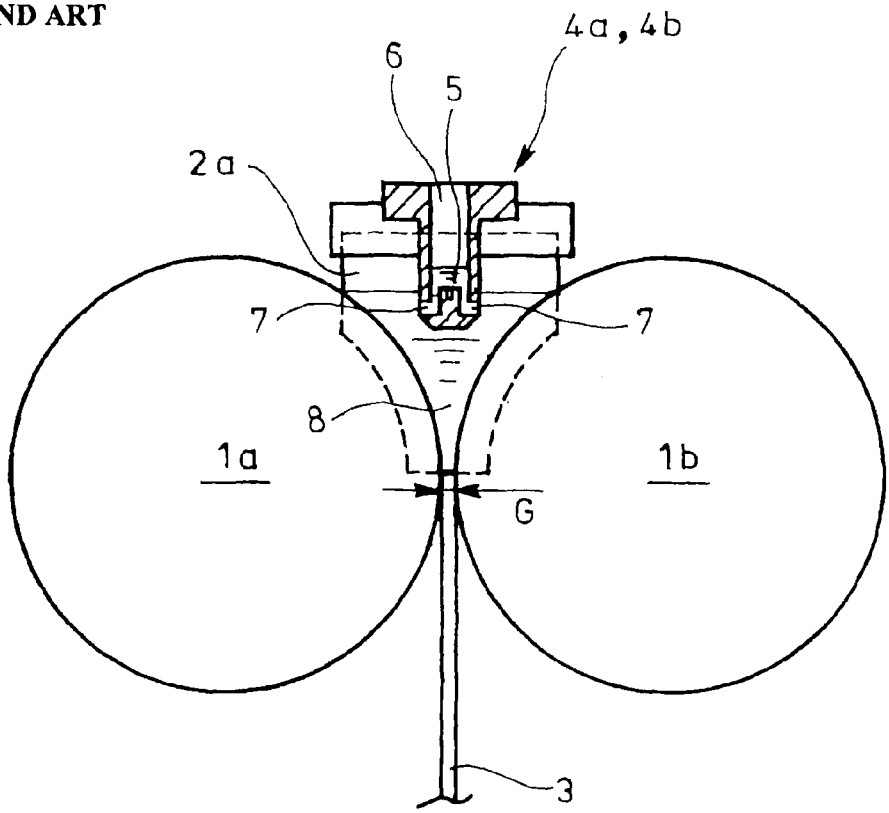
FIG.1 BACKGROUND ART
FIG. 1 is a schematic view showing an example of a conventional twin-roll casting machine laterally of chilled rolls.

1*a* chilled roll
1*b* chilled roll
2*a* side weir
2*a* side weir
5 molten metal
11*a* nozzle piece
11*b* nozzle piece
13 opening

DESCRIPTION OF EMBODIMENTS

Embodiments of the invention will be described in conjunction with the drawings.

FIGS. 4-7 show an embodiment of a twin-roll casting machine according to the invention with a pair of chilled rolls 1*a* and 1*b* horizontally juxtaposed, a pair of side weirs 2*a* and 2*b* associated with the rolls 1*a* and 1*b*, and nozzle pieces 11*a* and 11*b*.

One 11*a* of the nozzle pieces is positioned just above the nip G and is supported to have a constant gap against one 2*a* of the side weirs, the other nozzle piece 11*b* being positioned just above the nip G and being supported to have a constant gas against the other side weir 2*b*.

Each of the nozzle pieces 11*a* and 11*b* has a top with an elongated nozzle trough 12 for reception of molten metal 5, a plurality of openings 13 being on an inner bottom of the nozzle trough 12 and pass downwardly through the bottom, the openings 13 being dividedly arranged adjacent to the one and the other rolls 1*a* and 1*b*, respectively, and spaced apart from each other axially of the rolls 1*a* and 1*b*.

Figure 4:
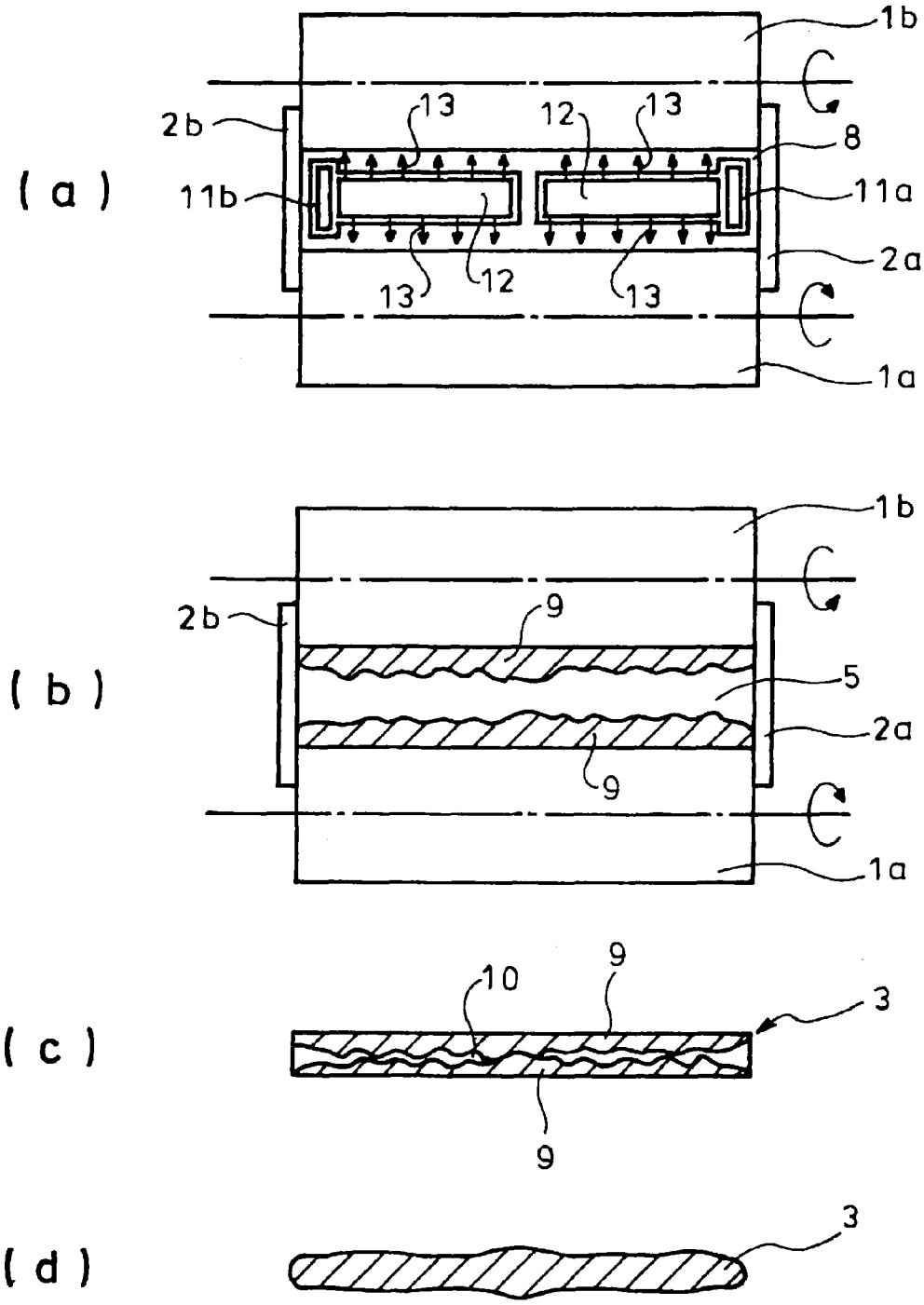
FIG. 4 is schematic views showing relationship between the nozzle pieces and cross-sectional shape of the strip in an embodiment of a twin-roll casting machine according to the invention.

As shown by arrows in FIG. 4(*a*), with respect to each of the nozzle pieces 11*a* and 11*b*, the openings 13 are formed alternately (in antiphase) at portions adjacent to the one and the other rolls 1*a* and 1*b*.

Figure 5:
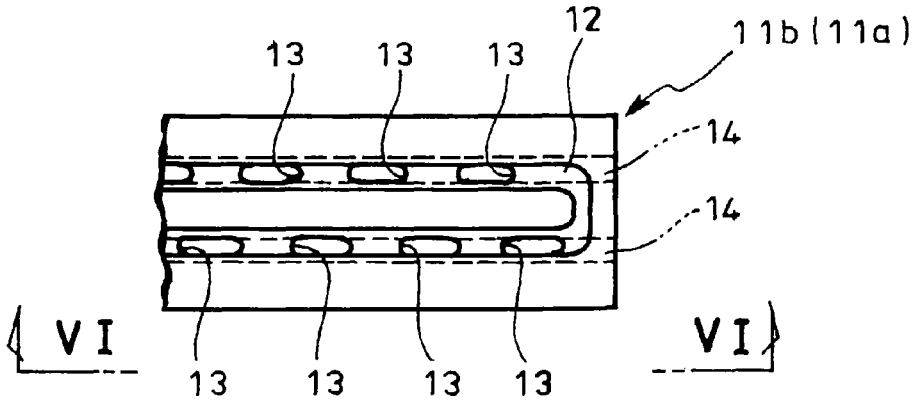
FIG. 5 is a partial plan view showing an example of a specific shape of the nozzle pieces in FIG. 4.
Figure 6:
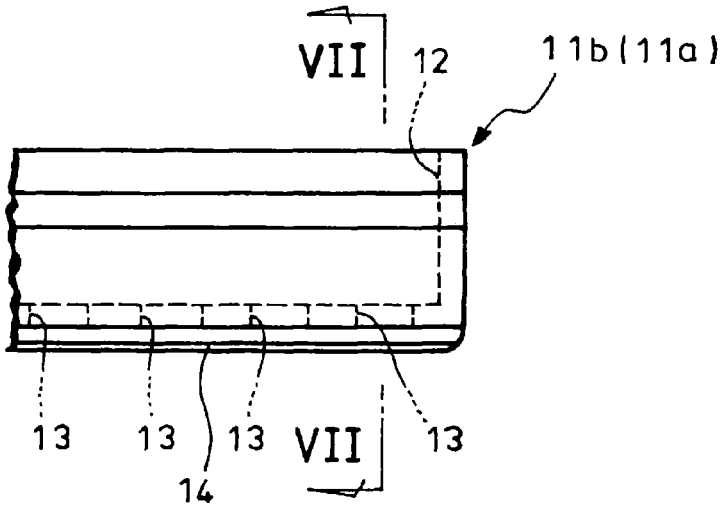
FIG. 6 is a view looking in direction of arrows VI in FIG. 5.
Figure 7:
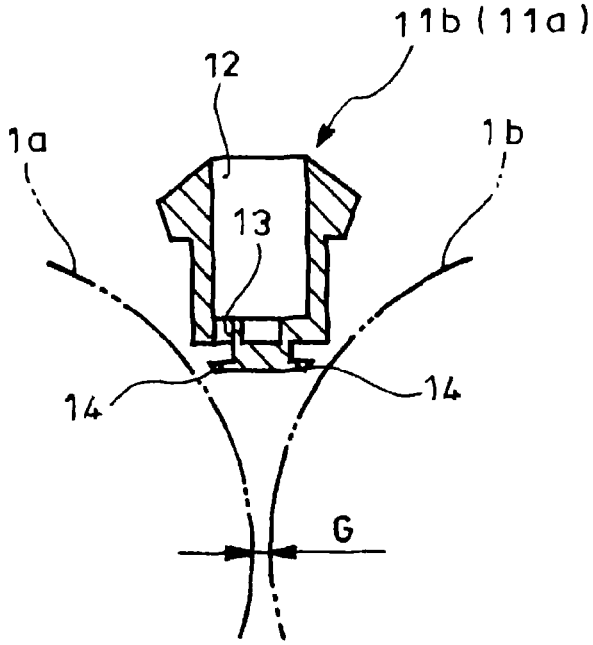
FIG. 7 is a view looking in direction of arrows VII in FIG. 6.

As shown in FIG. 5, the openings 13 are substantially formed to be oval in cross section extending axially of the rolls 1*a* and 1*b*.

A bottom of each of the nozzle pieces 11*a* and 11*b* has guides 14 which laterally guide the molten metal 5 flowing out from the respective openings 13 to outer peripheries of the rolls 1*a* and 1*b*, respectively, the guides extending throughout each of the nozzle pieces 11*a* and 11*b* (see FIGS. 6 and 7), so that pouring of the molten metal 5 into the nozzle troughs 12 brings about the molten metal pool 8 in contact with the outer peripheries of the rolls 1*a* and 1*b*.

In the above-mentioned twin-roll casting machine, the molten metal pool 8 is formed and the rolls 1*a* and 1*b* are rotated with the cooling water passing through and cooling the rolls 1*a* and 1*b*, so that the molten metal 5 is solidified on the outer peripheries of the rolls 1*a* and 1*b* into solidified shell 9 so as to deliver downward the strip 3 from the nip G.

In this case, as shown in FIG. 4(*a*), with respect to each of the nozzle pieces 11*a* and 11*b*, the openings 13 formed adjacent to the one roll 1*a* are in antiphase to those adjacent to the other roll 1*b* so that the solidified shells 9 on the outer peripheries of the one and the other rolls 1*a* and 1*b* are brought together as shown in FIG. 4(*c*) with ridges of the shell 9 with progressed solidification on the outer periphery of the one roll 1*a* being confronted to valleys of the shell 9 with unprogressed solidification on the outer periphery of the other roll 1*b* and similarly with valleys of the shell 9 on the outer periphery of the one roll 1*a* being confronted to ridges of the shell 9 on the outer periphery of the other roll 1*b*, as shown in FIG. 4(*b*).

Figure 2:
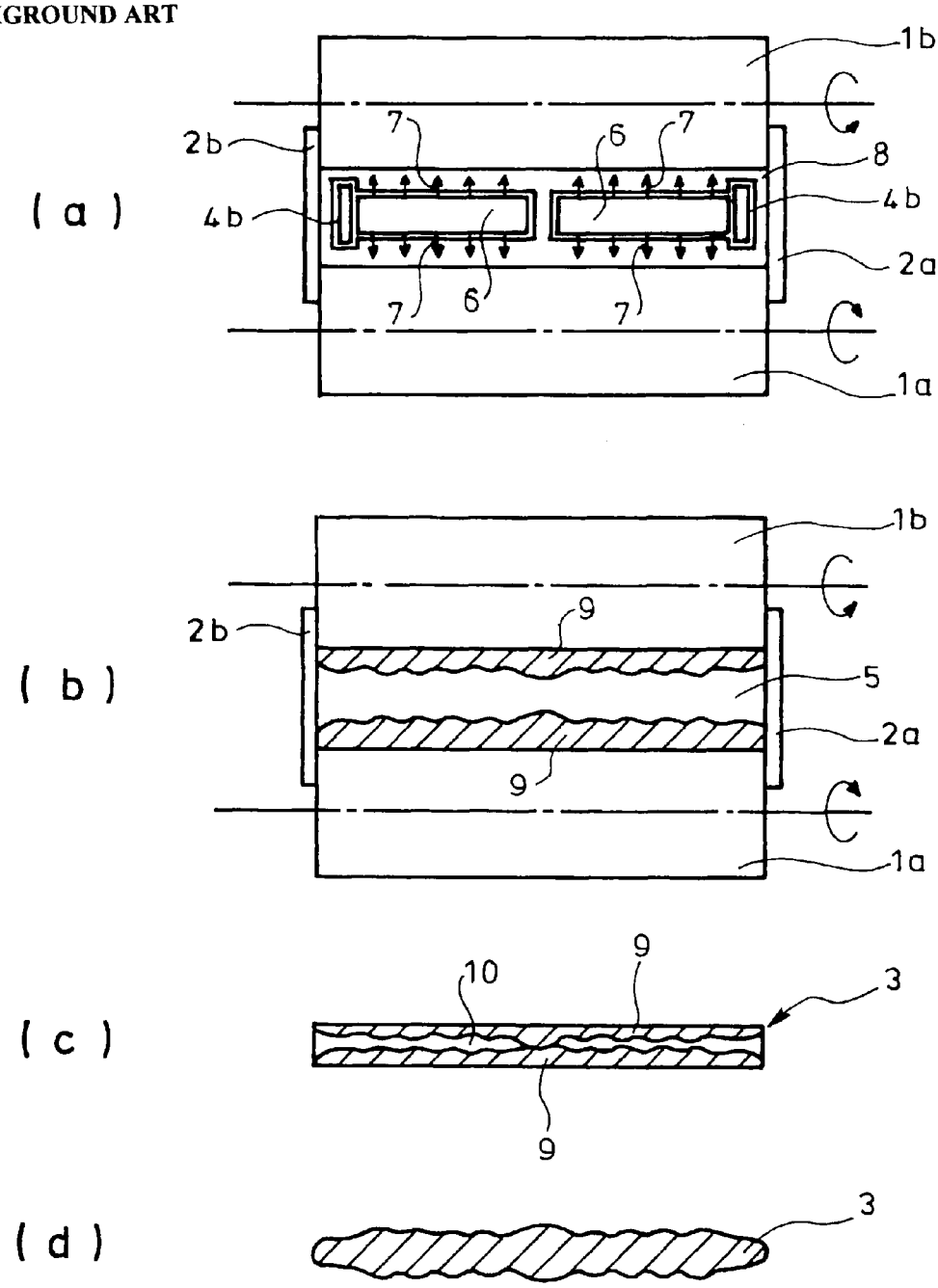
FIG.2 BACKGROUND ART
FIG. 2 is schematic views showing relationship between the nozzle pieces and cross-sectional shape of the strip in FIG. 1.
Figure 3:
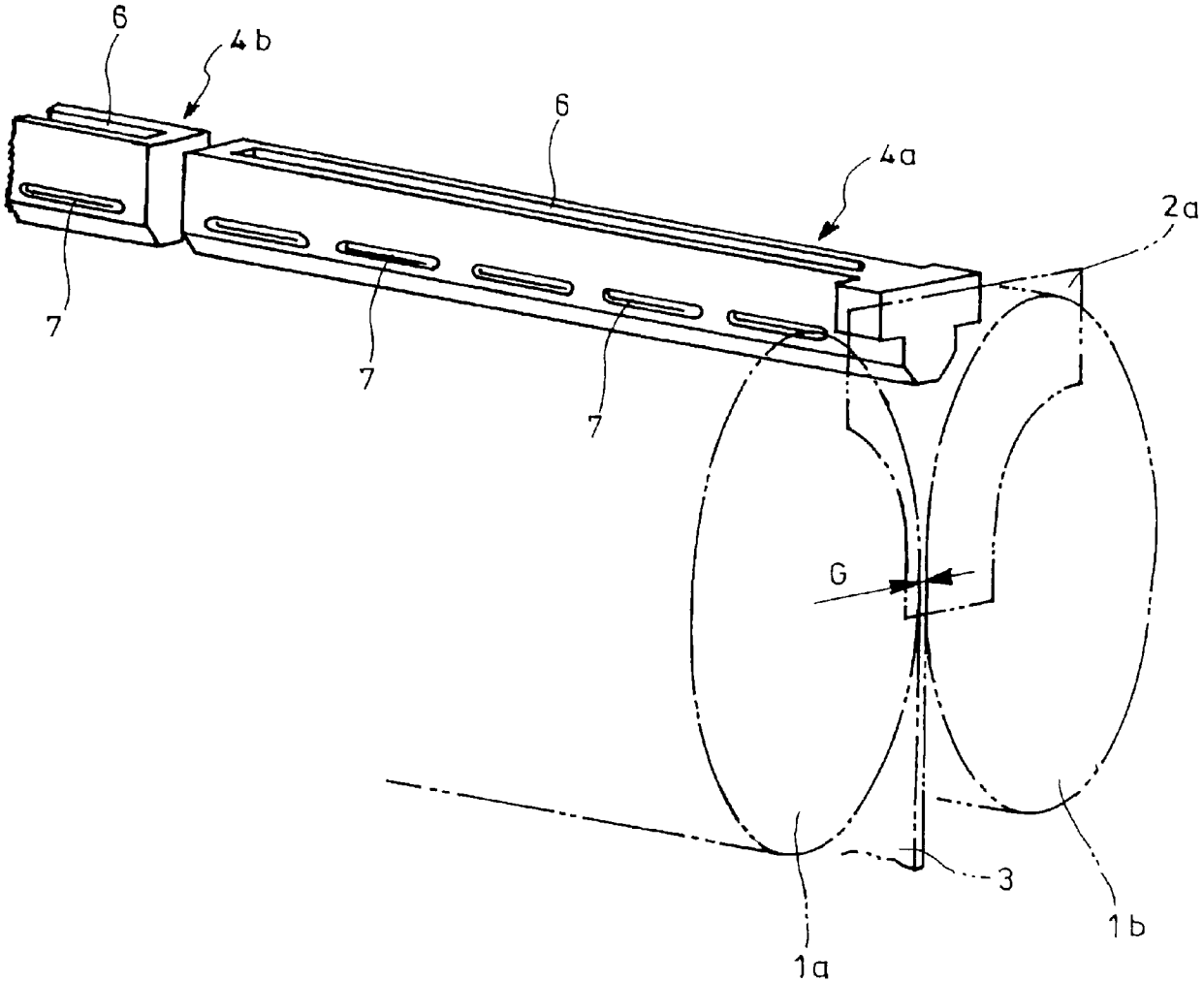
FIG.3 BACKGROUND ART
FIG. 3 is a schematic perspective view showing the twin-roll casting machine in FIG. 1.

Thus, the unsolidified regions 10 between both the solidified shells 9 are decreased in comparison with those of the prior art shown in FIG. 2(*c*). The strip 3 completely contracted due to solidification has tendency of being equalized with no irregularities in crosswise thickness distribution as shown in FIG. 4(*d*), cracks being prevented from being produced.

Figure 8:
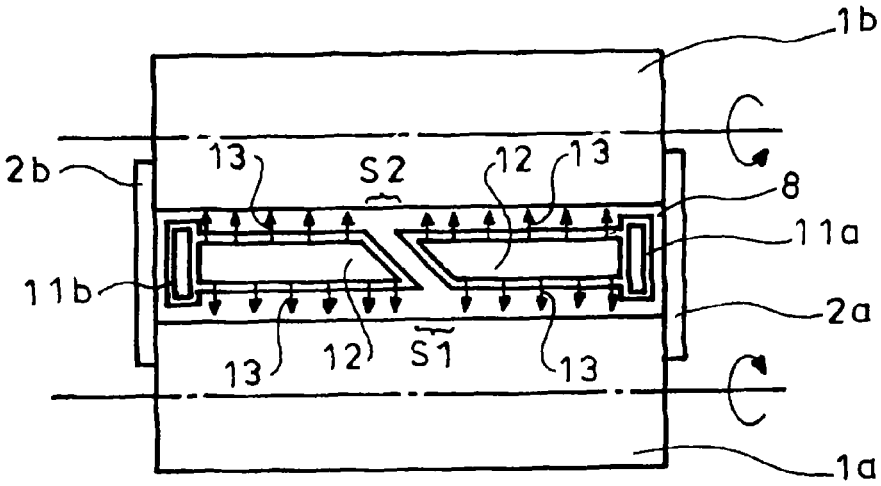
FIG. 8 is a schematic view showing nozzle pieces in a further embodiment of a twin-roll casting machine according to the invention.

FIG. 8 shows a further embodiment of a twin-roll casting machine according to the invention in which parts similar to those in FIGS. 4-7 are represented by the same reference numerals.

In this twin-roll casting machine, a pair of nozzle pieces 11*a* and 11*b* have opposed ends slanted to chilled rolls 1*a* and 1*b*, so that the nozzle piece 11*a* is shorter in length adjacent to the one roll 1*a* and is longer in length adjacent to the other roll 1*b* and the nozzle piece 11*b* is longer in length adjacent to the one roll 1*a* and is shorter in length adjacent to the other roll 1*b*.

As shown by arrows, with respect to each of the nozzle pieces 11*a* and 11*b*, the openings 13 are formed alternately (in antiphase) at portions adjacent to the one and the other rolls 1*a* and 1*b*.

Number of the openings 13 on the nozzle piece 11*a* adjacent to the roll 1*a* is less than that adjacent to the roll 1*b*; number of the openings 13 on the nozzle piece 11*b* adjacent to the roll 1*b* is less than that adjacent to the roll 1*a*.

In other words, the nozzle piece 11*a* is set to have smaller and greater molten-metal delivery ranges axially along the one and the other rolls 1*a* and 1*b*, respectively. The nozzle piece 11*b* is set to have greater and smaller molten-metal delivery ranges axially along the one and the other rolls 1*a* and 1*b*, respectively. As a result, a gap S1 between the nozzle pieces 11*a* and 11*b* on the side of the one roll 1*a* is not confronted to a gap S2 between the nozzle pieces 11*a* and 11*b* on the side of the other roll 1*b* diametrically of the rolls 1*a* and 1*b*.

Thus, a ridge of the solidified shell on the outer periphery of the one roll 1*a* at axially intermediate portion thereof is not confronted to a ridge of the solidified shell 9 on the outer periphery of the other roll 1*b* at axially intermediate portion thereof with an advantageous result that the strip 3 delivered by the roll 1*a* has further equalized crosswise thickness distribution (see FIG. 4 with respect to strip 3 and the solidified shells 9).

It is to be understood that a twin-roll casting machine of the invention is not limited to the above embodiments and that various changes and modifications may be made without departing from the scope of the invention.

INDUSTRIAL APPLICABILITY

A twin-roll casting machine of the invention may be applied to production of strips of steel and other various metals.

The invention claimed is:

1. A twin-roll casting machine, comprising:

a pair of chilled rolls, a pair of side weirs, and first and second nozzle pieces arranged in tandem axially along an axial direction of the rolls and in a space defined by said rolls and said side weirs, each of said first and second nozzle pieces being formed with a plurality of molten-metal delivery openings, spaced apart from each other along the axial direction of the rolls, in a first surface of each of said first and second nozzle pieces that is adjacent to a first one of the rolls, each of said first and second nozzle pieces being formed with a plurality of molten-metal delivery openings, spaced apart from each other along the axial direction of the rolls, in a second surface of each of said first and second nozzle pieces that is adjacent to a second one of the rolls, said openings in the first surface being alternately positioned from said openings in the second surface in each respective first and second nozzle piece, said alternately positioned openings being at a same height relative to a nip between the rolls, and said first and second nozzle pieces having opposed ends that are slanted to the rolls, so that in said first nozzle piece said first surface is shorter in length than said second surface, and in said second nozzle piece said first surface is longer in length than said second surface.

2. A twin-roll casting machine, comprising:

a pair of chilled rolls, a pair of side weirs, and first and second nozzle pieces arranged in tandem axially along an axial direction of the rolls and in a space defined by said rolls and said side weirs, each of said first and second nozzle pieces being formed with a plurality of molten-metal delivery openings, spaced apart from each other along the axial direction of the rolls, in a first surface of each of said first and second nozzle pieces that is adjacent to a first one of the rolls, each of said first and second nozzle pieces being formed with a plurality of molten-metal delivery openings, spaced apart from each other along the axial direction of the rolls, in a second surface of each of said first and second nozzle pieces that is adjacent to a second one of the rolls, said openings in the first surface being alternately positioned from said openings in the second surface in each respective first and second nozzle piece, said alternately positioned openings being at a same height relative to a nip between the rolls, said first and second nozzle pieces having opposed ends that are slanted to the rolls, so that in said first nozzle piece said first surface is shorter in length than said second surface, and in said second nozzle piece said first surface is longer in length than said second surface, and each of the openings having a cross section that is elongated axially along the axial direction of the rolls.

3. A twin-roll casting machine, comprising:

a pair of chilled rolls, a pair of side weirs, and first and second nozzle pieces arranged in tandem axially along an axial direction of the rolls and in a space defined by said rolls and said side weirs, each of said first and second nozzle pieces being formed with a plurality of molten-metal delivery openings, spaced apart from each other along the axial direction of the rolls, in a first surface of each of said first and second nozzle pieces that is adjacent to a first one of the rolls, each of said first and second nozzle pieces being formed with a plurality of molten-metal delivery openings, spaced apart from each other along the axial direction of the rolls, in a second surface of each of said first and second nozzle pieces that is adjacent to a second one of the rolls, said openings in the first surface being alternately positioned from said openings in the second surface in each respective first and second nozzle piece, and said first and second nozzle pieces having opposed ends that are slanted to the rolls, so that in said first nozzle piece said first surface is shorter in length than said second surface, in said second nozzle piece said first surface is longer in length than said second surface, and a gap between the first surface of said first nozzle piece and the first surface of said second nozzle piece does not diametrically oppose a gap between the second surface of said first nozzle piece and the second surface of said second nozzle piece.

* * * * *